US005192190A

United States Patent [19]

Ferleger et al.

[11] Patent Number: 5,192,190

[45] Date of Patent: Mar. 9, 1993

[54] ENVELOPE FORGED STATIONARY BLADE FOR L-2C ROW

[75] Inventors: Jurek Ferleger, Longwood; David H. Evans, Lake Mary, both of Fla.

[73] Assignee: Westinghouse Electric Corp., Pittsburgh, Pa.

[21] Appl. No.: 884,268

[22] Filed: May 8, 1992

Related U.S. Application Data

[63] Continuation of Ser. No. 624,367, Dec. 6, 1990, abandoned.

[51] Int. Cl.[5] ..... F01D 9/04

[52] U.S. Cl. ..... 415/191; 415/209.3

[58] Field of Search ..... 415/108, 191, 192, 181, 415/208.1, 209.3, 190, 914; 416/213 R, 195

[56] References Cited

U.S. PATENT DOCUMENTS

| | | | |
|---|---|---|---|
| 2,224,519 | 12/1940 | McIntyre | 415/192 |
| 2,299,449 | 10/1942 | Allen | 415/208.1 |
| 2,524,869 | 10/1950 | Adamtchik | 415/192 |
| 3,034,762 | 5/1962 | Fanti et al. | 416/195 |
| 3,313,520 | 4/1967 | Ortolano et al. | 415/209.4 |
| 3,339,889 | 9/1967 | Nyffeler | 416/213 R |
| 4,288,677 | 9/1981 | Sakata et al. | 416/213 R |
| 4,714,407 | 12/1987 | Cox et al. | 415/192 |
| 4,900,223 | 2/1990 | Groenendaal et al. | 415/208.1 |
| 4,900,230 | 2/1990 | Patel | 415/181 |

FOREIGN PATENT DOCUMENTS

| | | | |
|---|---|---|---|
| 1188819 | 1/1957 | France | 416/213 |
| 1194770 | 11/1959 | France | 416/213 |
| 1502855 | 8/1989 | U.S.S.R. | 415/208.1 |
| 964592 | 7/1964 | United Kingdom | 416/213 |

*Primary Examiner*—John T. Kwon

[57] ABSTRACT

A stationary blade for a steam turbine includes an airfoil portion having an inner diameter end and an outer diameter end; an inner ring portion integrally formed at the inner diameter end of the airfoil portion; and an outer ring portion integrally formed at the outer diameter end of the airfoil portion, the airfoil, inner ring and outer ring portions being envelope forged from a single bar stock, and each blade being welded together with an adjacent, substantially identical blade with welds provided at the inner and outer ring portions, the inner ring portion welds comprising a first, upstream weld and a second, downstream weld which is lower than the upstream weld.

21 Claims, 6 Drawing Sheets

ENVELOPE FORGED STATIONARY BLADE FOR L-2C ROW

This application is a continuation of application Ser. No. 07/624,367, filed Dec. 6, 1990, now abandoned.

BACKGROUND OF THE INVENTION

1. Field of the Invention

The present invention relates generally to steam turbine blades and, more particularly, to a stationary blade having improved performance characteristics.

2. Description of the Related Art

Steam turbine rotor and stationary blades are arranged in a plurality of rows or stages. The rotor blades of a given row are identical to each other and mounted in a mounting groove provided in the turbine rotor. Stationary blades, on the other hand, are mounted on a cylinder which surrounds the rotor.

Turbine rotor blades typically share the same basic components. Each has a root receivable in the mounting groove of the rotor, a platform which overlies the outer surface of the rotor at the upper terminus of the root, and an airfoil which extends upwardly from the platform.

Stationary blades also have airfoils, except that the airfoils of the stationary blades extend downwardly towards the rotor. The airfoils include a leading edge, a trailing edge, a concave surface, and a convex surface. The airfoil shape common to a particular row of blades differs from the airfoil shape for every other row within a particular turbine. In general, no two turbines of different designs share airfoils of the same shape. The structural differences in airfoil shape result in significant variations in aerodynamic characteristics, stress patterns, operating temperature, and natural frequency of the blade. These variations, in turn, determine the operating life of the turbine blade within the boundary conditions (turbine inlet temperature, pressure ratio, and rotational speed), which are generally determined prior to airfoil shape development.

Development of a turbine for a new commercial power generation steam turbine may require several years to complete. When designing rotor blades for a new steam turbine, a profile developer is given a certain flow field with which to work. The flow field determines the inlet angles (for steam passing between adjacent blades of a row), gauging, and the force applied on each blade, among other things. "Gauging" is the ratio of throat to pitch; "throat" is the straight line distance between the trailing edge of one blade and the suction surface of an adjacent blade, and "pitch" is the distance in the tangential direction between the trailing edges of the adjacent blades.

These flow field parameters are dependent on a number of factors, including the length of the blades of a particular row. The length of the blades is established early in the design stages of the steam turbine and is essentially a function of the overall power output of the steam turbine and the power output for that particular stage.

SUMMARY OF THE INVENTION

An object of the present invention is to provide an improved blade design with improved performance and manufacturability, suitable for retrofit into an existing turbine.

Another object of the present invention is to provide a stronger connection between adjacent blades of a group within a row of stationary blades.

Another object of the present invention is to optimize steam velocity distribution along pressure and suction surfaces of the blade.

These and other objects of the present invention are met by providing a stationary blade for a steam turbine which includes an airfoil portion having an inner diameter end and an outer diameter end, an inner ring portion integrally formed at the inner diameter end of the airfoil portion, and an outer ring portion integrally formed at the outer diameter end of the airfoil portion. The airfoil, inner ring and outer ring portions are envelope forged from a single bar stock and each blade is welded together with an adjacent, substantially identical blade with welds provided at the inner and outer ring portions. The inner ring portion welds include a first, upstream weld and a second, downstream weld which is lower than the upstream weld.

These and other features and advantages of the stationary blade of the present invention will become more apparent with reference to the following detailed description and drawings.

BRIEF DESCRIPTION OF THE DRAWINGS

FIG. 1(*a*) is a partial top view showing juxtaposed outer ring portions of the blade according to the present invention welded together;

DETAILED DESCRIPTION OF THE PREFERRED EMBODIMENTS

The blade design of the present invention is specific to the fifth stationary row of a low pressure fossil fuel steam turbine having a running speed of 3600 rpms. The present invention is retrofitted into an existing turbine, so that reliability and efficiency were improved according to the present invention, while fitting into an existing inner cylinder. The blade is 8.448 inches long and is constructed according to the diaphragm-type assembly method, as opposed to a segmental assembly. In a segmental assembly, inner and outer ring segments are welded to inner and outer diameter portions of the airfoil. A diaphragm-type method of manufacturing is one where the complete blade, with inner and outer ring segments formed together with the foil is manufactured from a bar stock and then machined to its final geometric shape by numeric control machining.

While this type of manufacturing process is generally known, it is associated with blades of much shorter length than the blade of the present invention. To facilitate the use of a diaphragm-type assembly, the blade of the present invention is designed with a unique airfoil which minimizes forging energy. The details of the airfoil will be described below.

Figure 1:
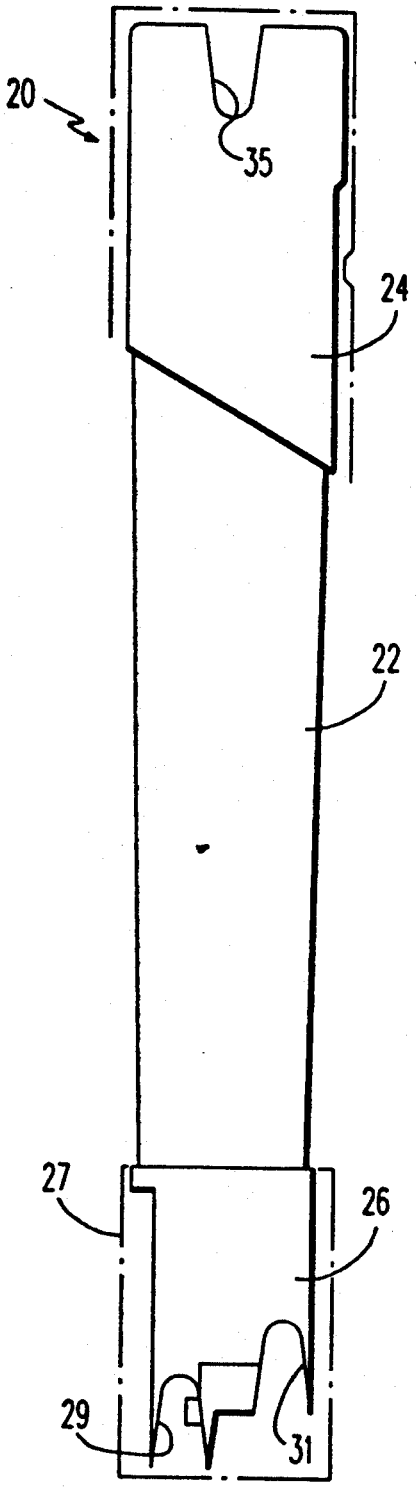
FIG. 1 is a side elevational view of a stationary blade according to the present invention.
Figure 2:
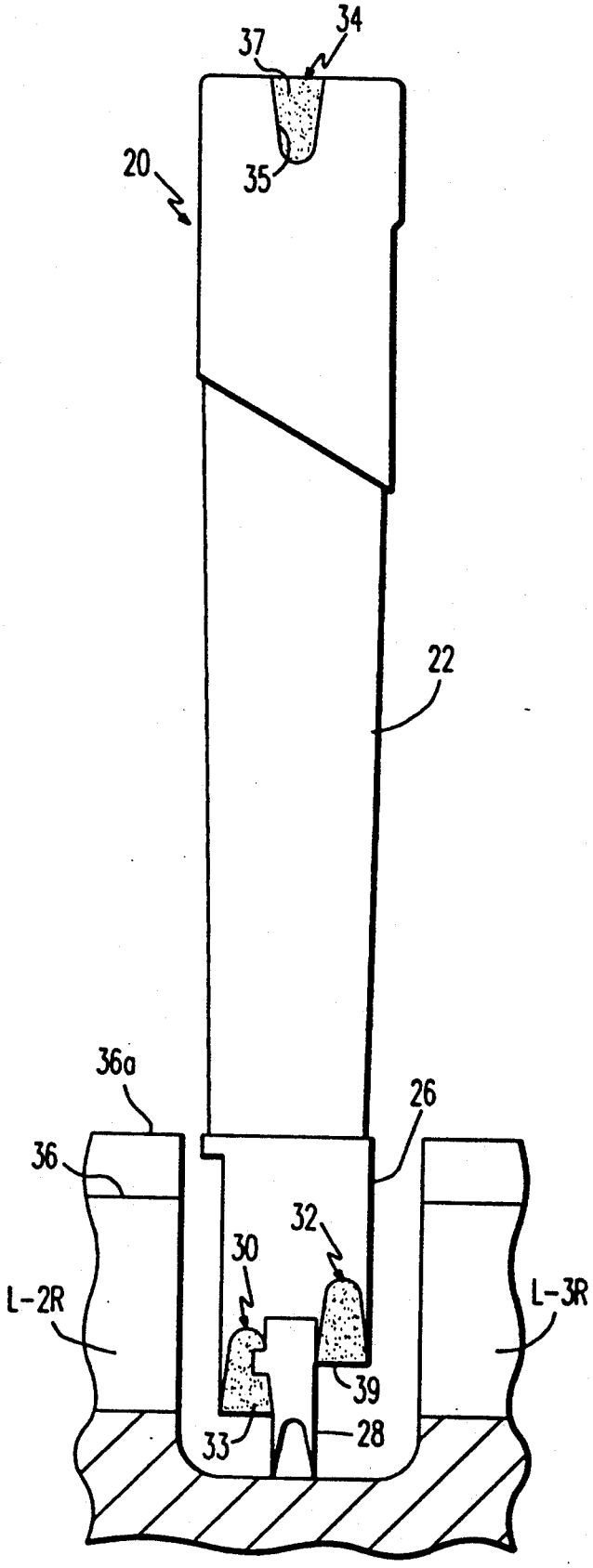
FIG. 2 is a side elevational view of the blade of FIG. 1, with the corresponding rotor portions shown in cross-section.

Referring to FIG. 1, a stationary blade 20 of the present invention has an airfoil portion 22, an outer ring portion 24 and an inner ring portion 26. The broken lines 25 and 27 indicate areas of the outer and inner ring portions which were machined away after diaphragm assembly. The finished version of the blade 20 is illustrated in FIG. 2 as having a seal 28 mounted in the end of the inner ring portion 26 between welds 30 and 32. The welds 32 are staggered, with weld 30, which is the downstream weld, being lower than the upstream weld 32. This arrangement strengthens the weld joint for the seal 28. An additional weld 34 is provided in the outer ring portion 24 for assembly into the cylinder.

The "inner diameter" end of the airfoil 22 is indicated in FIGS. 1 and 2 to be at a radius of 29.94 inches (760.476 mm). This refers to the fact that the inner diameter end of the airfoil is 29.94 inches (760.476 mm) from the rotational axis of the rotor. The outer diameter end of the airfoil 22 is at a radius of 38.388 inches (975.0552 mm). The difference between the outer diameter end and the inner diameter end gives the length of the airfoil as approximately 8.45 inches (214.63 mm). FIG. 2 illustrates a corresponding portion of the L-2R rotating blade 36 which has platform outer surface **36*a* of the same diameter as the inner diameter end of the airfoil 22. A groove of the rotor 36 into which the stationary blade 20 extends has a height of 3.462 inches (87.935 mm), which corresponds to the height of the inner ring portion 26 and seal 28** combined.

After diaphragm machining, the inner ring portion 26 is left with a unique shape which effectively tunes the fundamental mode of the entire structure between the multiples of turbine running speed (approximately 200 Hz) without having to undergo other tuning techniques. Also, the welds 30 and 32 are made deeper than previous welds in order to increase the strength of the structure.

Figure 3:
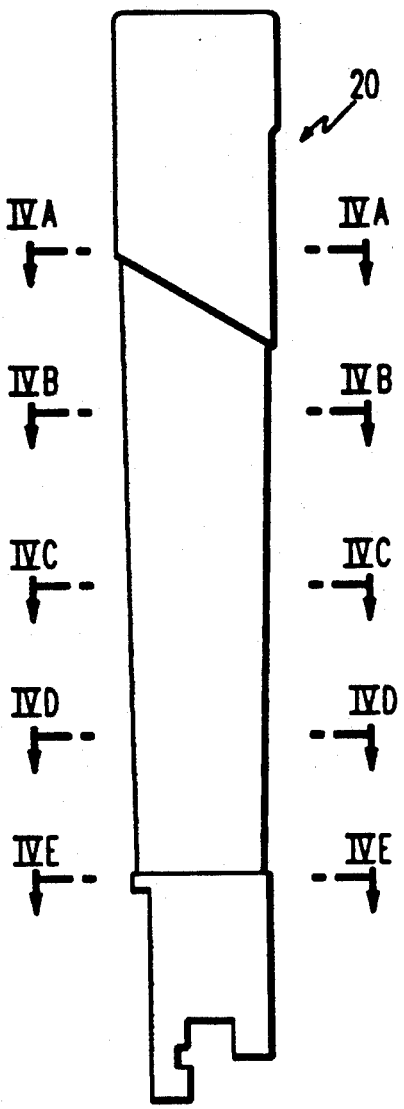
FIG. 3 is a side elevational view of the stationary blade of FIG. 1, showing five basic sections A—A through E—E.

FIG. 3 shows a series of stacked sections A—A through E—E of the airfoil portion 22 of the blade 20.

Figure 5:
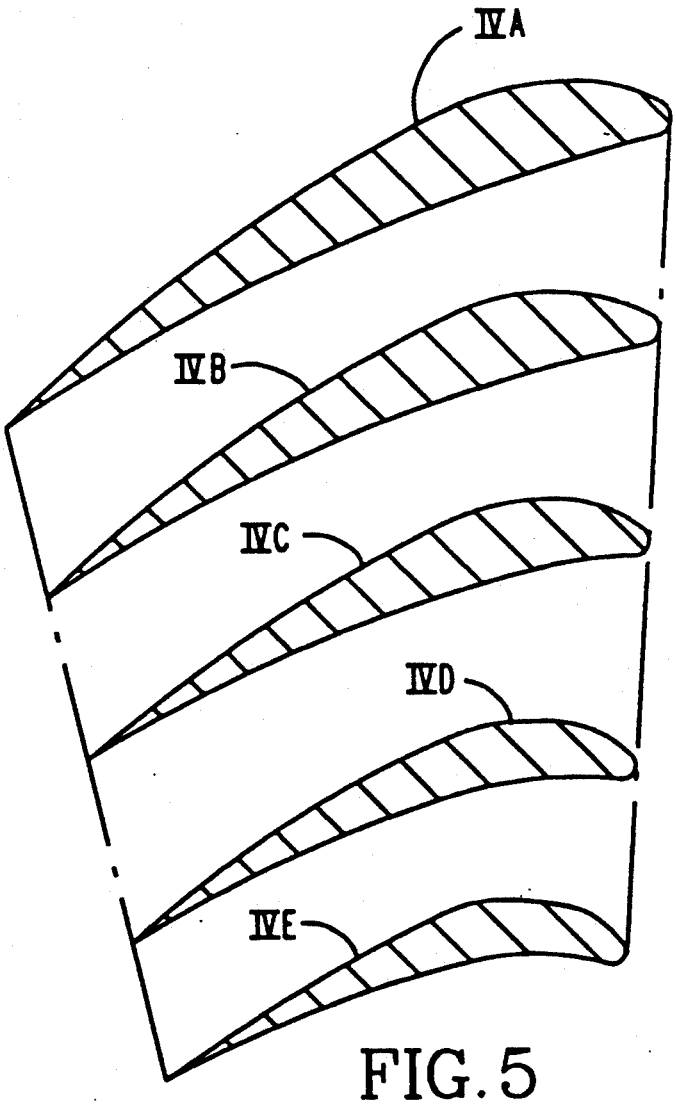
FIG. 5 is a perspective view of the five basic sections of FIG. 3.
Figures 4A, 4B, 4C, 4D, 4E:
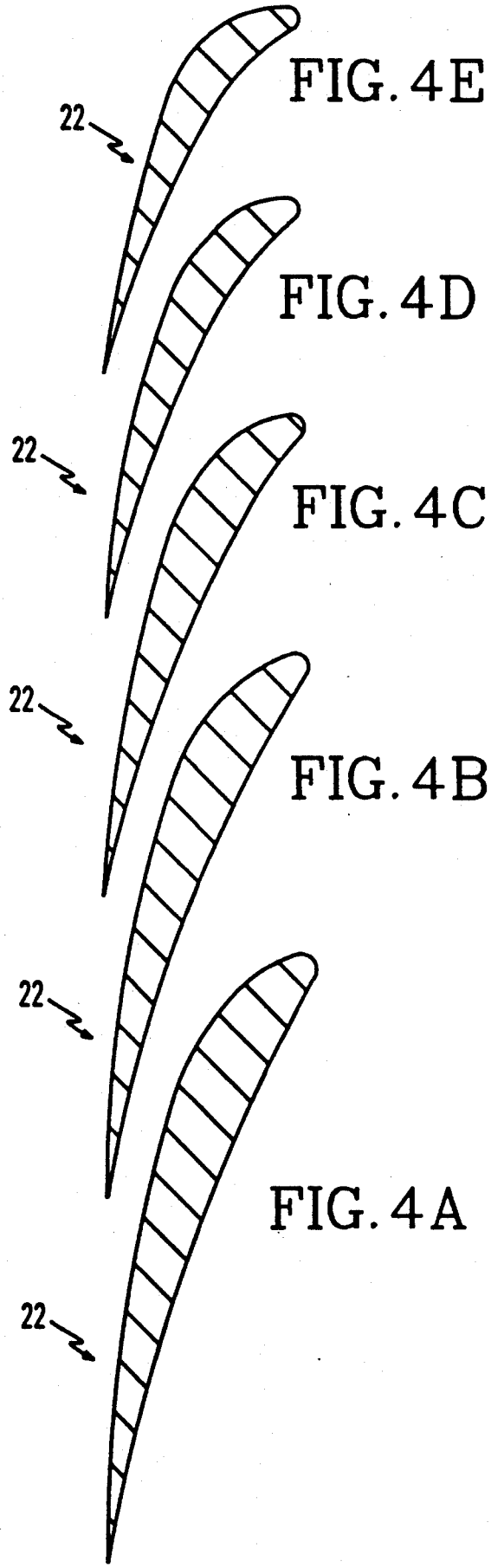
FIGS. 4(*a*) through 4(*e*) are sectional views of the five basic sections of FIG. 3.

FIGS. 4A through 4E are cross sections of sections A—A through E—E. These stacked plots are helpful in illustrating the taper/twist profile of the airfoil portion of the blade. One feature of the present invention which is illustrated in FIGS. 4A–4E is that the centers of the leading and trailing edges form a straight line equation in space. This feature, which is further illustrated in FIG. 5 which is a perspective plot of the foil, further leads to simplified manufacturing.

Weld 34 is made by forming a groove 35 and filling it with weld material 37 so that when adjacent ring portions **24*a*, 24*b*, 24*c*, etc. are juxtaposed side-by-side an arcuate channel is formed collectively by the plurality of grooves 34, this channel being filled by weld material 37 by deposit welding to form an arcuate weld line which binds together the outer ring portions. Similarly, welds 30 and 32 are made by forming grooves 29 and 31 in the inner ring portion 26 and filling these grooves with weld material 33 and 39** when the inner ring portions are juxtaposed side-by-side.

The following table summarizes the geometric features of the blade according to the present invention:

| SECTION | E-E | D-D | C-C | B-B | A-A |
|---|---|---|---|---|---|
| RADIUS | | | | | |
| (IN) | 29.9400 | 31.9400 | 34.1630 | 36.4400 | 38.3875 |
| (mm) | 760.476 | 811.276 | 867.740 | 925.576 | 975.042 |
| PITCH | 2.2395 | 2.3981 | 2.5554 | 2.7257 | 2.8714 |
| WIDTH | | | | | |
| (IN) | 1.71426 | 1.78185 | 1.85713 | 1.93401 | 2.00003 |
| (mm) | 43.542 | 45.258 | 47.171 | 49.123 | 50.800 |
| CHORD (IN) | 3.0042 | 3.42199 | 3.89786 | 4.39290 | 4.82024 |
| PITCH/WIDTH | 1.30640 | 1.34080 | 1.37599 | 1.40935 | 1.43566 |
| PITCH/CHORD | .74540 | .69816 | .65559 | .62048 | .59569 |
| STAGGER ANGLE (DEG) | 54.56409 | 58.02105 | 61.00489 | 63.37520 | 64.99626 |
| MAXIMUM THICKNESS | .44793 | .46287 | .50189 | .55821 | .61890 |
| MAXIMUM THICKNESS/CHORD | .14909 | .13526 | .12876 | .12707 | .12840 |
| EXIT OPENING | | | | | |
| (IN) | .67198 | .63777 | .60295 | .57674 | .55710 |
| (mm) | 17.068 | 16.199 | 15.314 | 14.649 | 14.150 |
| EXIT OPENING ANGLE | 26.60294 | 23.28277 | 20.34495 | 18.66529 | 17.34476 |
| INLET INCL. ANGLE | 62.75663 | 59.63185 | 55.92893 | 50.14567 | 47.17303 |
| EXIT INCL. ANGLE | 6.05101 | 6.68777 | 6.34746 | 6.30626 | 8.10422 |
| AREA (IN**2) | .75121 | .91433 | 1.14569 | 1.43819 | 1.73475 |
| ALPHA (DEG) | 55.84176 | 59.51541 | 62.44364 | 64.49169 | 66.04618 |
| I MIN (IN**4) | .01511 | .01861 | .02481 | .03421 | .04615 |
| I MAX (IN**4) | .34856 | .56503 | .92310 | 1.45221 | 2.11677 |
| GAUGING | .672 | .638 | .603 | .577 | .557 |
| INLET ANGLE | 86.12 | 92.13 | 103.2 | 115.3 | 122.3 |
| EXIT ANGLE | 17.5 | 15.47 | 13.71 | 12.45 | 11.43 |

Figure 6:
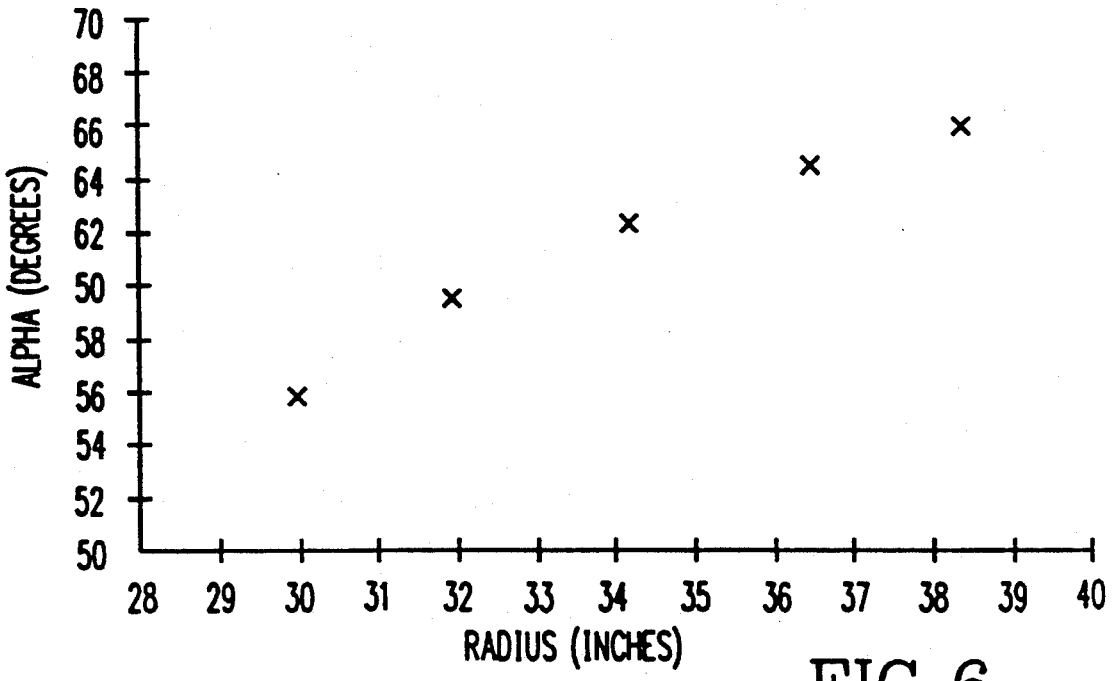
FIGS. 6–9 are graphs showing geometric and performance characteristics of the blade according to FIG. 1.
Figure 7:
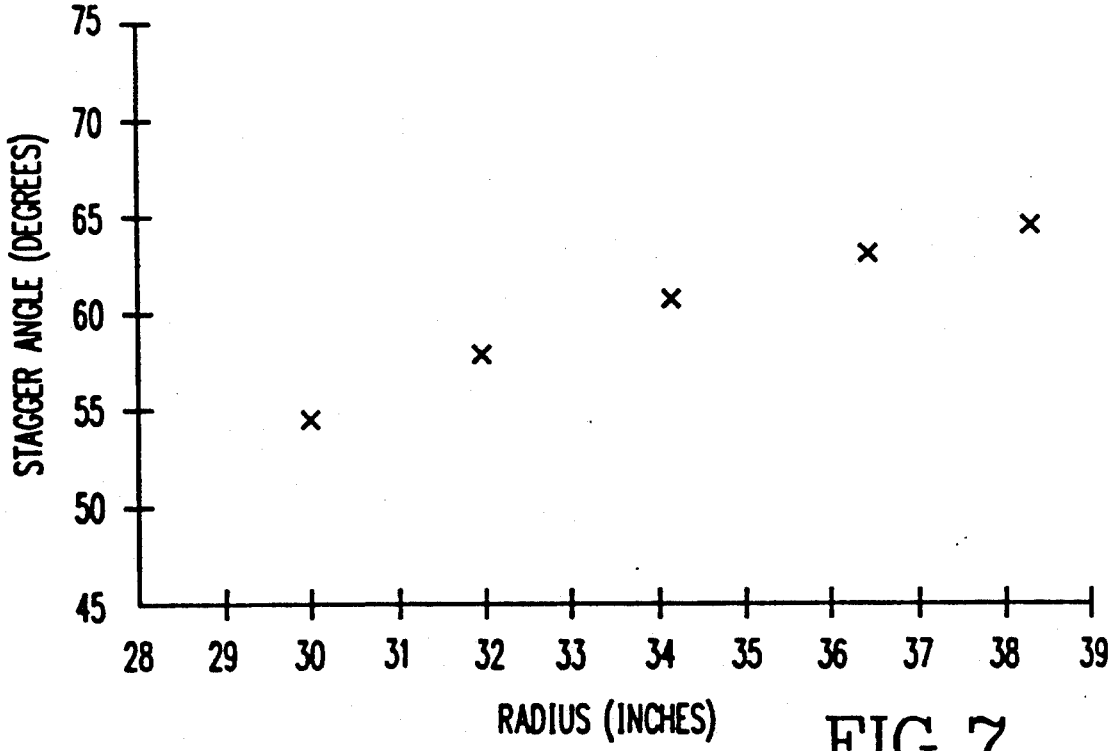

Certain relationships between the values stated in the above table are illustrated graphically in FIGS. 6–9. In FIGS. 6–9, the axis denotes the radius in inches from the longitudinal center line of the rotor. Thus, the ordinate of the first point on the graph of FIG. 6 represents the radial distance of the E—E section, which according to the foregoing table is 29.94 inches. The Y axis of FIG. 6 represents the alpha angle, measured in degrees. The alpha angle is the principal axis angle with respect to the X—X axis. It is noteworthy that the curve generated by the five points plotted on the graph illustrated in FIG. 6 is a smooth curve, which approximates the curve generated in FIG. 7. FIG. 7 illustrates the stagger angle versus radius for each of the five sections. The stagger angle is the angle of each section chord to the X—X axis.

Figure 10:
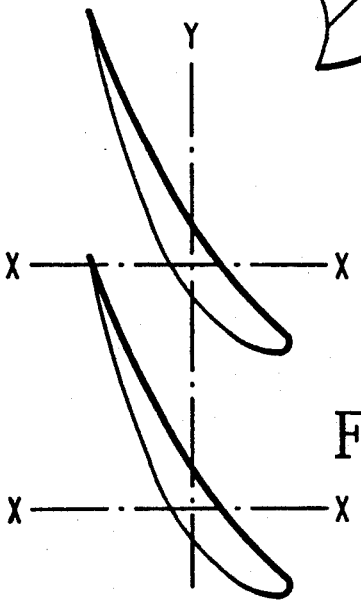
FIG. 10 shows a typical section of the blade according to FIG. 1, showing two adjacent blades of the same row relative to the X—X axis.

A typical section, the C—C section, is illustrated in FIG. 10. FIG. 10 further illustrates the gauging of the C—C section, as well as the X—X radial plane which extends outwardly from the longitudinal axis of the rotor. The Y—Y plane is transverse the longitudinal axis of the rotor.

Figure 8:
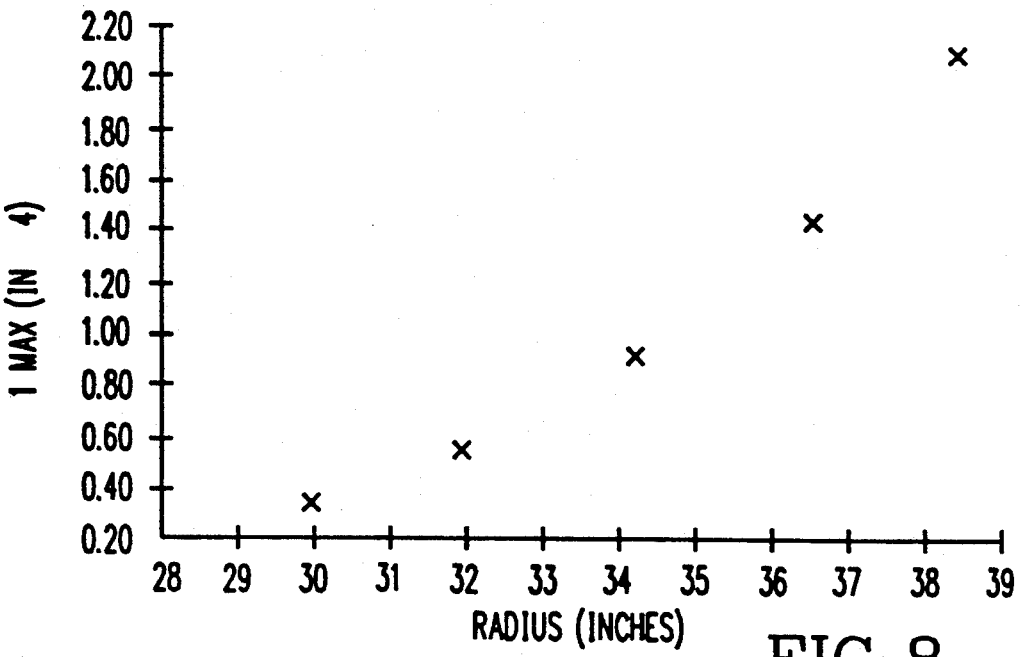
Figure 9:
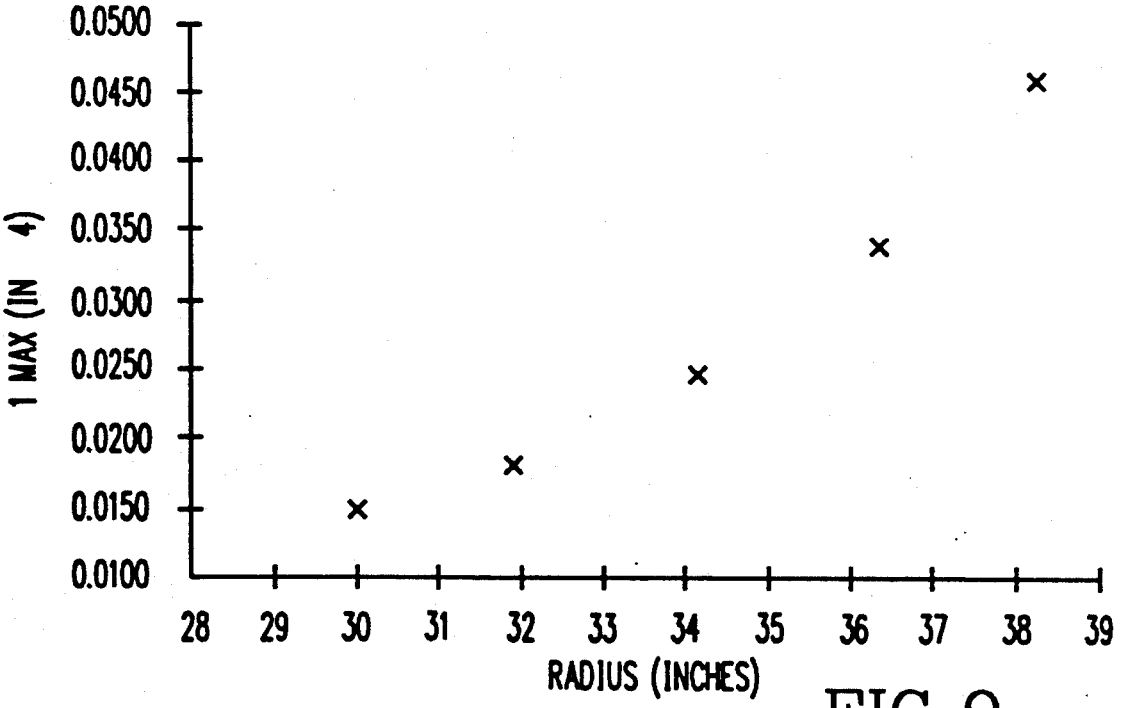

FIGS. 8 and 9 illustrate the relationship between I MIN and I MAX with respect to radius. It can be seen from FIGS. 8 and 9 that I MIN and I MAX both increase parabolically, with increasing radius. Both I MIN and I MAX are measurements of resistance to bending.

The blade design detailed herein has achieved optimum stage efficiency by using numerous design considerations such as minimizing the steam flow incidence angle. The ideal inlet angle radial distribution was obtained using flow field analysis, which also leads to the unique gauging distribution along the radial length of the blade.

The unique radial distribution of inlet angle allows a smooth steam flow from the parallel-sided upstream blading. The performance of the blade according to the present invention is further improved by optimizing blade pressure and suction surfaces steam velocity distribution.

It should also be noted that the blade of the present design is specific to a fossil fuel steam turbine known as the "BB72" ruggedized, and in particular for the L-2C stationary row. This is the third stationary row from the low pressure turbine exit, and there are 84 blades per row, with the blades being grouped into groups of 8 or 9, thus making ten groups per row.

Figure 11:
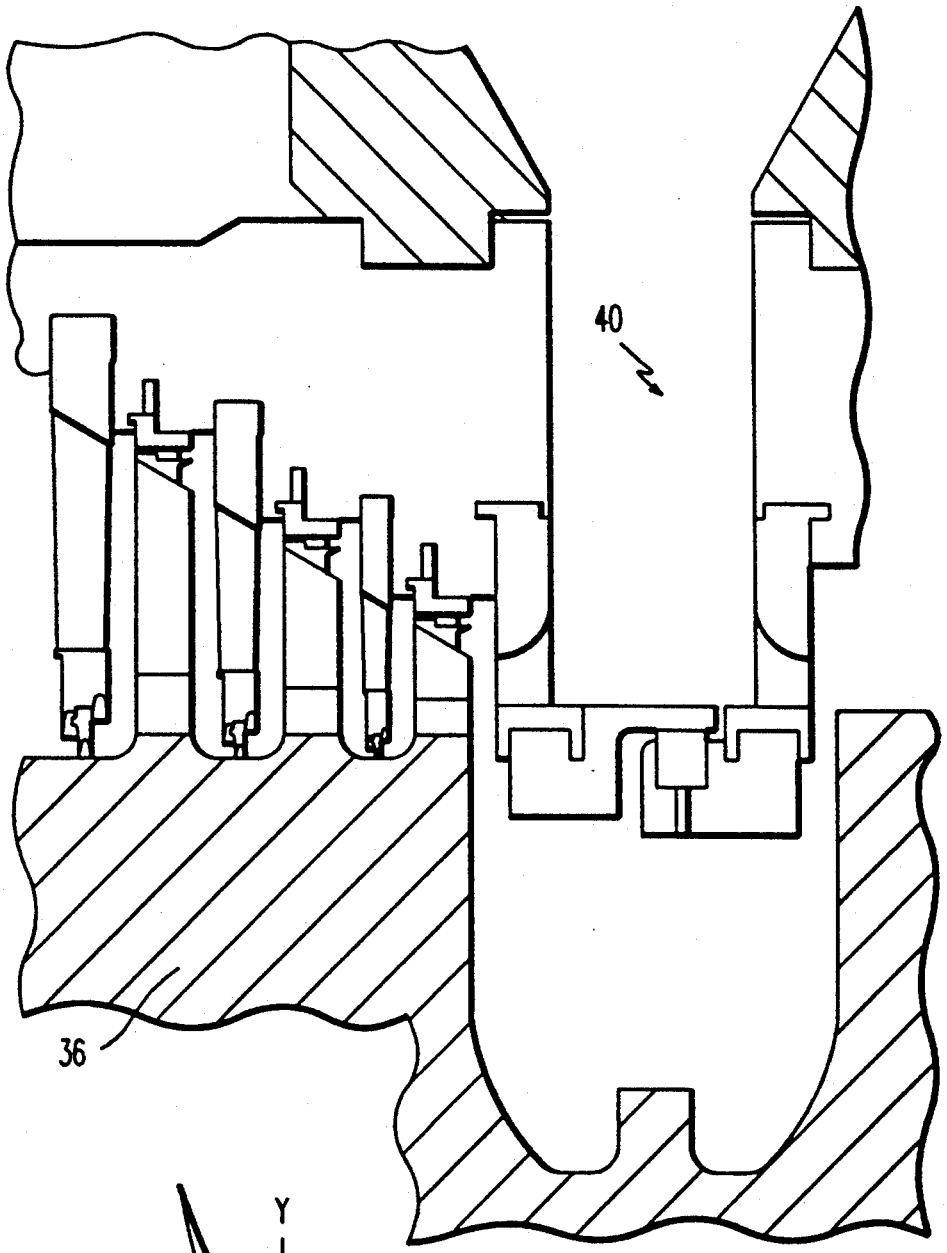
FIG. 11 is a side elevational view, partly in section of a portion of a steam turbine which incorporates a row of stationary blades according to FIG. 1.

FIG. 11 illustrates the position of the 2C row of stationary blades with respect to the steam inlet 40.

What is claimed is:

1. A stationary blade for mounting in a stream turbine stationary cylinder comprising:

an airfoil portion having an inner diameter end and an outer diameter end;

a portion of an inner ring corresponding to the airfoil portion being integrally formed at the inner diameter end of the airfoil portion; and a portion of an outer ring corresponding to the airfoil portion, being integrally formed at the outer diameter end of the airfoil and being connected to the stationary cylinder of the steam turbine, the airfoil, inner ring and outer ring portions being one piece, said blade having a first groove formed in an end surface of the outer ring portion and extending from side to side for receiving weld material when additional blades of the same configuration are grouped together with the outer and inner ring portions juxtaposed side-by-side so that the weld material interconnects the outer ring portions, said inner ring portion having a stepped end and including a first step surface and a second step surface, said blade further having second and third grooves formed respectively in the first and second stepped surfaces of the inner ring portion and extending from side to side for receiving weld material when the additional blades of the same configuration are grouped together so that the weld material interconnects the inner ring portions.

2. A stationary blade as recited in claim 1, wherein the airfoil portion is 8.45 inches long.

3. A stationary blade as recited in claim 1, wherein the airfoil portion is divided into five basic sections extending from the inner diameter end to the outer diameter end, and wherein a ratio of pitch to chord decreases from about 0.745 at the inner diameter sections to about 0.60 at the outer diameter section.

4. A stationary blade as recited in claim 1, wherein the airfoil portion is divided into five basic sections extending from the inner diameter end to the outer diameter end, and wherein a ratio of pitch to width increases from about 1.3 at the inner diameter section to about 1.4 at the outer diameter section.

5. A stationary blade as recited in claim 1, wherein the airfoil portion is divided into five basic sections extending from the inner diameter end to the outer diameter end, and wherein a stagger angle increases from about 55° at the inner diameter section to about 65° at the inner diameter section.

6. A stationary blade as recited in claim 1, wherein the airfoil portion is divided into five basic sections extending from the inner diameter end to the outer diameter end, and wherein a value of minimum moment of inertia (I MIN) and a value of maximum moment of inertia (I MAX) increase parabolically from the inner diameter section to the outer diameter section.

7. A stationary blade as recited in claim 1, wherein the airfoil portion is divided into five basic sections extending from the inner diameter end to the outer diameter end, and wherein a ratio of maximum thickness to chord for each section decreases from about 0.15 at the inner diameter section to about 0.13 at the outer diameter.

8. A stationary blade as recited in claim 1, wherein the airfoil portion is divided into five basic sections extending from the inner diameter end to the outer diameter end, and wherein a chord of each section increases from about 3 inches at the inner diameter section to about 4.82 inches at the outer diameter section.

9. A stationary blade as recited in claim 1, wherein the airfoil portion if divided into five basic sections extending from the inner diameter end to the outer diameter end, wherein a value of minimum moment of inertia (I MIN) and a value of a maximum moment of inertia (I MAX) increase parabolically from the inner diameter section to the outer diameter section; wherein a ratio of maximum thickness to chord for each section decreases from about 0.15 at the inner diameter section to about 0.13 at the outer diameter section; and wherein a chord of each section increase from about 3 inches at the inner diameter section to about 4.82 inches at the outer diameter section.

10. A stationary blade as recited in claim 1, wherein the airfoil portion is divided into five basic sections extending from the inner diameter end to the outer diameter end, and wherein a ratio of pitch to chord decreases from about 0.745 at the inner diameter sections to about 0.60 at the outer diameter section; wherein a ratio of pitch to width increases from about 1.3 at the inner diameter section to about 1.4 at the outer diameter section; wherein a stagger angle increases from about 55° at the inner diameter section to about 60° at the outer diameter section; wherein a value of minimum moment of inertia (I MIN) and a value of maximum moment of inertia ( I MAX) increase parabolically from the inner diameter section to the outer diameter section; wherein a ratio of maximum thickness to chord for each section decreases from about 0.15 at the inner diameter section to about 0.13 at the outer diameter section; and wherein a chord of each section increases from about 3 inches at the inner diameter section to about 4.82 inches at the outer diameter section.

11. A row of stationary blades for a low pressure steam turbine, said row including 84 blades and being third of plural stationary blade rows from a turbine exit, each blade comprising:

an airfoil portion having an inner diameter end and an outer diameter end;

a portion of an inner ring corresponding to the airfoil portion being integrally formed at the inner diameter end of the airfoil portion; and a portion of an outer ring corresponding to the airfoil portion, being integrally formed at the outer diameter end of the airfoil portion and being connected to a casing, the airfoil, inner ring and outer ring portions being one piece, said blade being arranged in a row with a plurality of substantially identical blades so that the inner and outer ring portions of the blades are juxtaposed side-by-side, and welded together through a first circumferential weld extending around the outer ring portions and second and third circumferential welds extending around the inner ring portions, and said second weld being an upstream weld and said third weld being a downstream weld which is lower than the second, upstream weld.

12. A stationary blade as recited in claim 11, wherein the airfoil portion is 8.45 inches long.

13. A stationary blade as recited in claim 11, wherein the airfoil portion is divided into five basic sections extending from the inner diameter end to the outer diameter end, and wherein a ratio of pitch to chord decreases from about 0.745 at the inner diameter section to about 0.60 at the outer diameter section.

14. A stationary blade as recited in claim 11, wherein the airfoil portion is divided into five basic sections extending from the inner diameter end to the outer diameter end, and wherein a ratio of pitch to width increases from about 1.3 at the inner diameter section to about 1.4 at the outer diameter section.

15. A stationary blade as recited in claim 11, wherein the airfoil portion is divided into five basic sections extending from the inner diameter end to the outer diameter end, and wherein a stagger angle increases from about 55° at the inner diameter section to about 65° at the outer diameter section.

16. A stationary blade as recited in claim 11, wherein the airfoil portion is divided into five basic sections extending from the inner diameter end to the outer diameter end, and wherein a value of minimum moment of inertia (I MIN) and a value of maximum moment of inertia (I MAX) increase parabolically from the inner diameter section to the outer diameter section.

17. A stationary blade as recited in claim 11, wherein the airfoil portion is divided into five basic sections extending from the inner diameter end to the outer diameter end, and wherein a ratio of maximum thickness to chord for each section decreases from about 0.15 at the inner diameter section to about 0.13 at the outer diameter.

18. A stationary blade as recited in claim 11, wherein the airfoil portion is divided into five basic sections extending from the inner diameter end to the outer diameter end, and wherein a chord of each section increases from about 3 inches at the inner diameter section to about 4.82 inches at the outer diameter section.

19. A stationary blade as recited in claim 11, wherein the airfoil portion is divided into five basic sections, extending from the inner diameter end to the outer diameter end, and wherein a value of minimum moment of inertia (I MIN) and a value of maximum moment of inertia (I MAX) increase parabolically from the inner diameter section to the outer diameter section; wherein a ratio of maximum thickness to chord for each section decreases from about 0.15 at the inner diameter section to about 0.13 at the outer diameter section; and wherein a chord of each section increases from about 3 inches at the inner diameter section to about 4.82 inches at the outer diameter section.

20. A stationary blade as recited in claim 11, wherein the airfoil portion is divided into five basic sections, extending from the inner diameter end to the outer diameter end, and wherein a ratio of pitch to chord decreases from about 0.745 at the inner diameter section to about 0.60 at the outer diameter section; wherein a ratio of pitch to width increases from about 1.3 at the inner diameter section to about 1.4 at the outer diameter section; wherein a stagger angle increases from about 55° at the inner diameter section to about 65° at the outer diameter section; wherein a value of minimum moment of inertia and a value of maximum moment of inertia increase at an increasing rate from the inner diameter section to the outer diameter sectional; wherein a ratio of maximum thickness to chord for each section decreases from about 0.15 at the inner diameter section to about 0.13 at the outer diameter section; and wherein a chord of each section increases from about 3 inches at the inner diameter section to about 4.82 inches at the outer diameter section.

21. Blading for an L-2C row of a BB72 steam turbine formed in accordance with the following table:

| SECTION | E-E | D-D | C-C | B-B | A-A |
|---|---|---|---|---|---|
| RADIUS | | | | | |
| (IN) | 29.9400 | 31.9400 | 34.1630 | 36.4400 | 38.3875 |
| (mm) | 760.476 | 811.276 | 867.740 | 925.576 | 975.042 |
| PITCH | 2.2395 | 2.3981 | 2.5554 | 2.7257 | 2.8714 |
| WIDTH | | | | | |
| (IN) | 1.71426 | 1.78185 | 1.85713 | 1.93401 | 2.00003 |
| (mm) | 43.542 | 45.258 | 47.171 | 49.123 | 50.800 |
| CHORD (IN) | 3.0042 | 3.42199 | 3.89786 | 4.39290 | 4.82024 |
| PITCH/WIDTH | 1.30640 | 1.34080 | 1.37599 | 1.40935 | 1.43566 |
| PITCH/CHORD | .74540 | .69816 | .65559 | .62048 | .59569 |
| STAGGER ANGLE (DEG) | 54.56409 | 58.02105 | 61.00489 | 63.37520 | 64.99626 |
| MAXIMUM THICKNESS | .44793 | .46287 | .50189 | .55821 | .61890 |
| MAXIMUM THICKNESS/CHORD | .14909 | .13526 | .12876 | .12707 | .12840 |
| EXIT OPENING | | | | | |
| (IN) | .67198 | .63777 | .60295 | .57674 | .55710 |
| (mm) | 17.068 | 16.199 | 15.314 | 14.649 | 14.150 |

-continued said dimensions from above being within normal tolerances.

| SECTION | E-E | D-D | C-C | B-B | A-A |
|---|---|---|---|---|---|
| EXIT OPENING ANGLE | 26.60294 | 23.28277 | 20.34495 | 18.66529 | 17.34476 |
| INLET INCL. ANGLE | 62.75663 | 59.63185 | 55.92893 | 50.14567 | 47.17303 |
| EXIT INCL. ANGLE | 6.05101 | 6.68777 | 6.34746 | 6.30626 | 8.10422 |
| AREA (IN**2) | .75121 | .91433 | 1.14569 | 1.43819 | 1.73475 |
| ALPHA (DEG) | 55.84176 | 59.51541 | 62.44364 | 64.49169 | 66.04618 |
| I MIN (IN**4) | .01511 | .01861 | .02481 | .03421 | .04615 |
| I MAX (IN**4) | .34856 | .56503 | .92310 | 1.45221 | 2.11677 |
| GAUGING | .672 | .638 | .603 | .577 | .557 |
| INLET ANGLE | 86.12 | 92.13 | 103.2 | 115.3 | 122.3 |
| EXIT ANGLE | 17.5 | 15.47 | 13.71 | 12.45 | 11.43 |

* * * * *